United States Patent [19]

Quaintance

[11] Patent Number: 4,981,253

[45] Date of Patent: Jan. 1, 1991

[54] CAN CARRIER WITH INTEGRAL HANDLE

[75] Inventor: Benjamin W. Quaintance, Griffin, Ga.

[73] Assignee: International Paper Company, Purchase, N.Y.

[21] Appl. No.: 369,159

[22] Filed: Jun. 21, 1989

[51] Int. Cl.[5] ..... B65D 5/46

[52] U.S. Cl. ..... 229/117.13; 206/141; 206/427

[58] Field of Search ..... 229/117.12, 117.13; 206/141, 427, 434

[56] References Cited

U.S. PATENT DOCUMENTS

| | | | |
|---|---|---|---|
| 2,785,847 | 3/1957 | Forrer | 229/117.13 |
| 4,340,170 | 7/1982 | Montealegre | 229/117.13 |
| 4,653,686 | 3/1987 | Wood et al. | 229/117.13 |
| 4,706,876 | 11/1987 | Wilson | 229/117.13 |
| 4,811,894 | 3/1989 | Schuster | 229/117.13 |

FOREIGN PATENT DOCUMENTS

| | | | |
|---|---|---|---|
| 1103372 | 2/1968 | United Kingdom | 206/141 |
| 1602857 | 11/1981 | United Kingdom | 229/117.12 |

*Primary Examiner*—Gary Elkins
*Attorney, Agent, or Firm*—Michael J. Doyle

[57] ABSTRACT

A corrugated paperboard carton for carrying a plurality of cans such as soft drink cans. The carton is formed from a unitary blank which is folded and glued, the upper panel of the erected carton provided with precut lines to form a handle opening for the insertion of the fingers of a purchaser, one of the precut lines being in the form of a (longitudinal) half ellipse. The handle region of the carton is provided with flex lines to assist in uniform distribution of stress and thereby minimize high stress concentrations. The handle arrangement is also such that one or more of the cans in the carton assist in distributing stresses within the paperboard when the carton is carried. In a second embodiment of the invention, the handle opening is a complete, open ellipse, the narrow ends of the ellipse extending into the carton side walls. According to a third embodiment, a pair of partially elliptical flaps partially cover an elliptical handle opening and are foldable about respective elliptical fold lines. The two ends of the handle opening are open and extend from the handle panel into respective side walls.

17 Claims, 6 Drawing Sheets

CAN CARRIER WITH INTEGRAL HANDLE

BACKGROUND OF THE INVENTION

This invention relates in general to cartons for carrying a plurality of metal cans such as soft drink or other beverage cans. The prior art is aware of a variety of constructions relating to can carriers, many of which are fashioned from a single blank of paperboard or corrugated paperboard, the paperboard being scored, glued and folded to form a carton or carrier. The latter also include a handle element, with this handle element being an integral part of the carton blank. Examples of such constructions are shown in U.S. Pat. Nos. 4,405,078 issued to Dutcher et al, 4,558,816 issued to Wood and 4,728,026 issued to Schuster.

SUMMARY OF THE INVENTION

According to the practice of this invention, a hand carried can carrier or carton is fashioned from a single blank of stiff, resilient and foldable sheet material such as paperboard or corrugated paperboard. The blank is provided with cut lines, flex lines and fold lines and is thereafter squared up or erected and filled with its contents, typically filled soft drink cans. The carrier of this invention is capable of being initially formed into a rectangular tube which is then collapsed and shipped to the packager. The cartons are erected by the packager, filled with cans, and then closed to thereby define a completed carrier. The carton is in the general form of a rectangular parallelepiped, i.e., is of brick shape, and its upper, horizontal wall (the handle panel) is provided with means for forming an aperture to receive four fingers of one hand for carrying the loaded (soft drink cans, etc.) carton. The aperture thus functions as and defines an integral handle.

In a first embodiment of the invention, the configuration of a main precut line which forms the handle is such as to inhibit tearing of the paperboard when the loaded carton is carried by the purchaser. The precut lines include a first or main cut line extending completely across the handle panel and terminating, at both ends of the former, in a respective adjacent side wall. This first line is preferably in the form of a (longitudinal) half ellipse, with its ends terminating in oppositely curved arcs. A pair of spaced apart, flap forming curved cut lines extend from the concave side of the half ellipse cut line. The flap remains in the plane of the handle panel until pushed down by the purchaser upon picking up the carton, the flap thus serving to protect the carton contents from ambient contaminants during storage and shipment, and also to prevent a cut edge of the handle panel from directly engaging the fingers of the purchaser. A flex score line (uncut) is provided in each side wall to assist in transferring stress in the corrugated board to some of the cans. Flex lines (uncut) are also provided in the handle panel to control stress.

In a second embodiment, the integral handle is formed by a complete, relatively narrow elliptical opening whose major axis is transverse to the length of the handle panel. The narrow ends of the elliptical handle opening extend into the adjacent side walls of the carton. Such a shape and location for a handle-defining opening has been found to inhibit tearing of the sheet material when the loaded carton is lifted and carried by the consumer.

A third embodiment employs a transverse elliptical opening in the handle panel whose narrow ends also extend into the carton side walls. A pair of flaps extend from the relatively flat opposite sides of the ellipse to cover the handle opening, each flap being foldable about a respective elliptical score line. While the transverse extent of the flaps is less than the entire width of the handle panel or wall, most of the handle opening is closed until the fingers of the consumer are inserted through the opening by pushing down on one or both flaps.

The curved elliptical form of the handle opening in each embodiment of the invention serves to more uniformly distribute or spread the lifting force which must be applied at the handle area to balance the weight of the can-loaded carton. When lifted, the upper or handle panel bends, at the side of the handle opening where the fingers of the purchaser are located, from a flat to a curved form. By making this side of the handle opening elliptical, the stress distribution and geometrical shape of the handle side are more evenly matched.

DETAILED DESCRIPTION OF THE INVENTION

Figure 1:
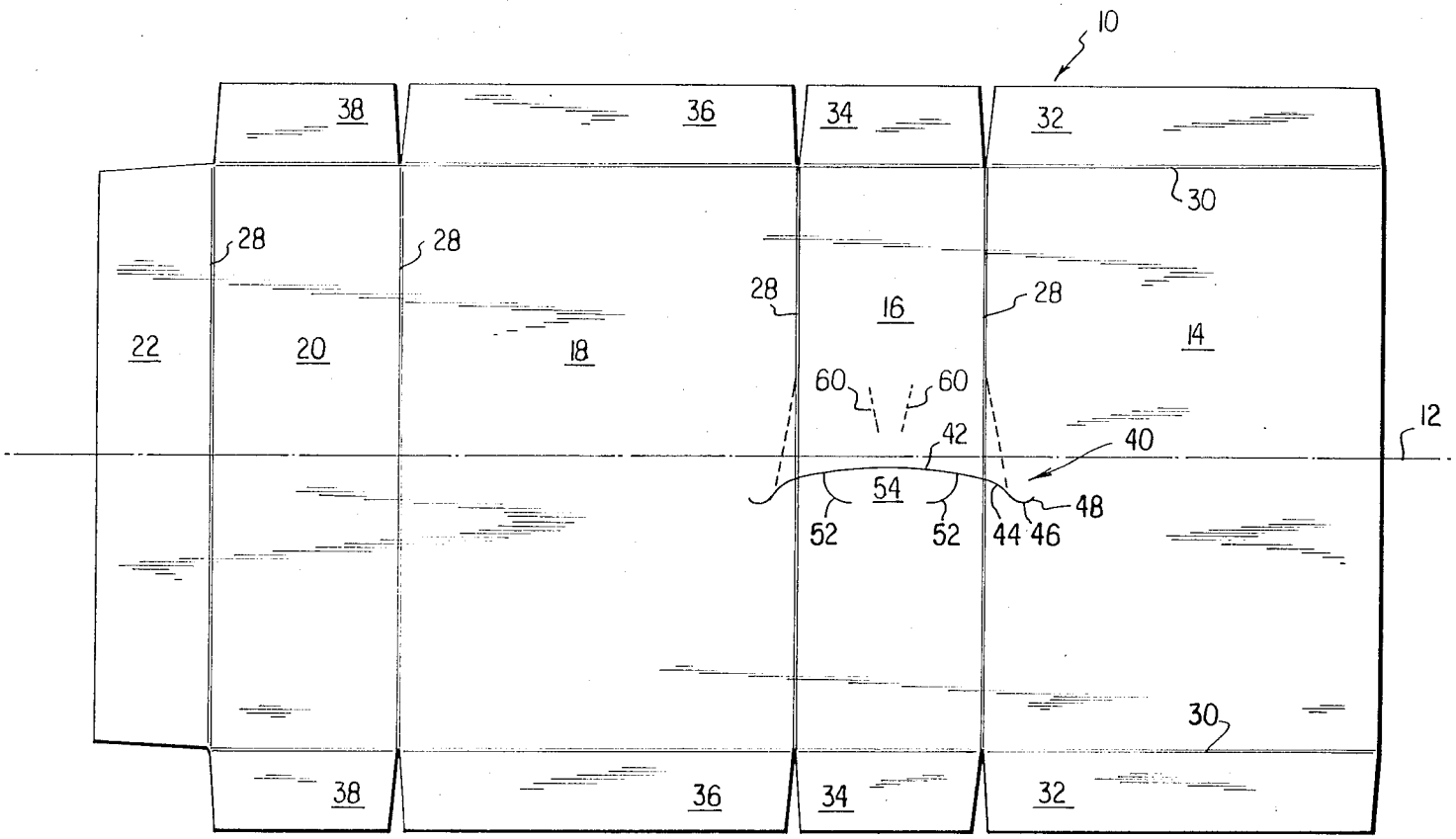
FIG. 1 is a plan view showing the inside surface of a unitary blank for forming the can carrier of this invention.
Figure 2:
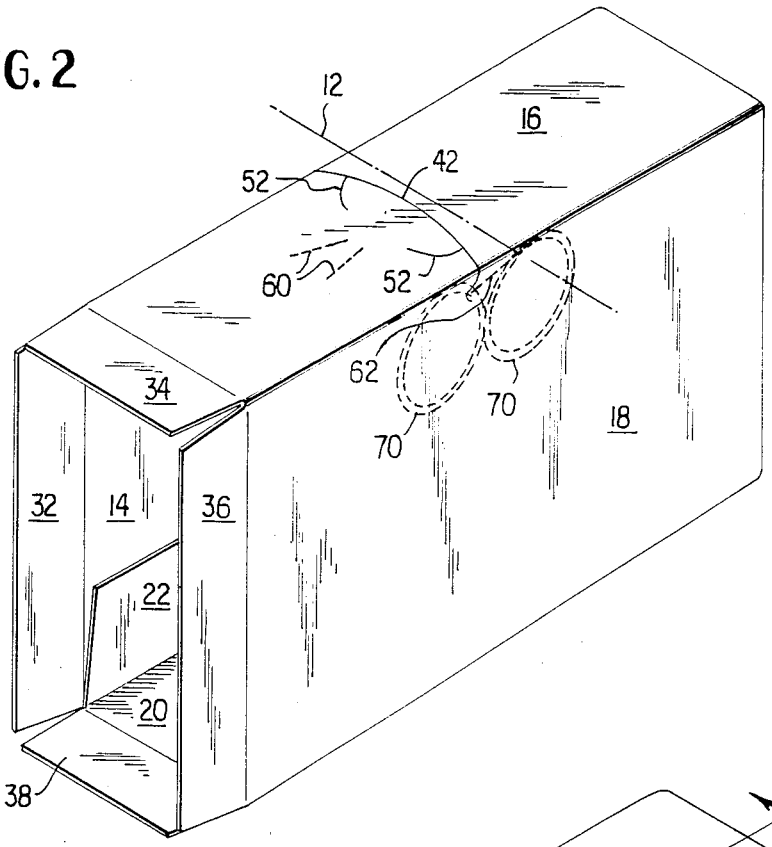
FIG. 2 is a perspective view showing the blank of FIG. 1 as partially erected so as to form an open ended, rectangular tube.

Referring now to FIG. 1 of the drawings, the numeral 10 denotes generally a flat blank from which the carton of this invention is formed, the blank being defined by corrugated paperboard or paperboard and including a plurality of panels defined by and foldably joined together by fold lines. The central longitudinal blank axis is denoted by 12. The numeral 14 denotes a first side panel foldably joined to a upper or handle forming panel 16, the latter foldably joined to a second side panel 18, the latter foldably joined to a bottom panel 20. Bottom panel 20 may be provided with a conventional manufacturer's flap 22 which is adapted to be glued to the right hand, free edge of panel 14. Conventionally, both this latter portion of panel 14 and flap 22 may be crushed prior to their joining. The numeral 28 denotes any one of a plurality of vertically extending score lines which define the fold lines joining the serially connected main panels and manufacturer's flap. The numeral 30 denotes either of two horizontally extending fold forming score lines separating end forming panels 32, 34, 36 and 38 from their respective main panels 14, 16, 18 and 20.

The numeral 40 denotes generally a plurality of precut lines, extending completely through the blank, formed in the blank which define the handle of this invention. The numeral 42 denotes a first curved line, preferably in the form of a longitudinal half ellipse, the major axis of the ellipse running transversely of handle panel 16. The ellipse is mirror symmetrical around the longitudinal midportion of handle panel 16. Each end of elliptical cut line 42 terminates at an end region 44 in a respective side panel 14, 18. Respective ends 44 of cut line 42 terminate at the initiation of curved cut lines 46 each having a terminal end 48. Curved cut lines 46 are each in the form of a circular arc of 90 degrees angular extent. Cut lines 42 and 46 form a continuous cut, with the two cut lines 46 each being of a curvature opposite in direction to that of cut line 42.

Curved cut lines 52 (referred to as fourth and fifth cut lines) are each of about 90 degrees angular extend, with one end of each extending orthogonally out from the concave side of cut line 42. A hinge line 53, extending between the free ends of cuts 52, is formed automatically when handle flap 54 is pushed down.

Figure 6:
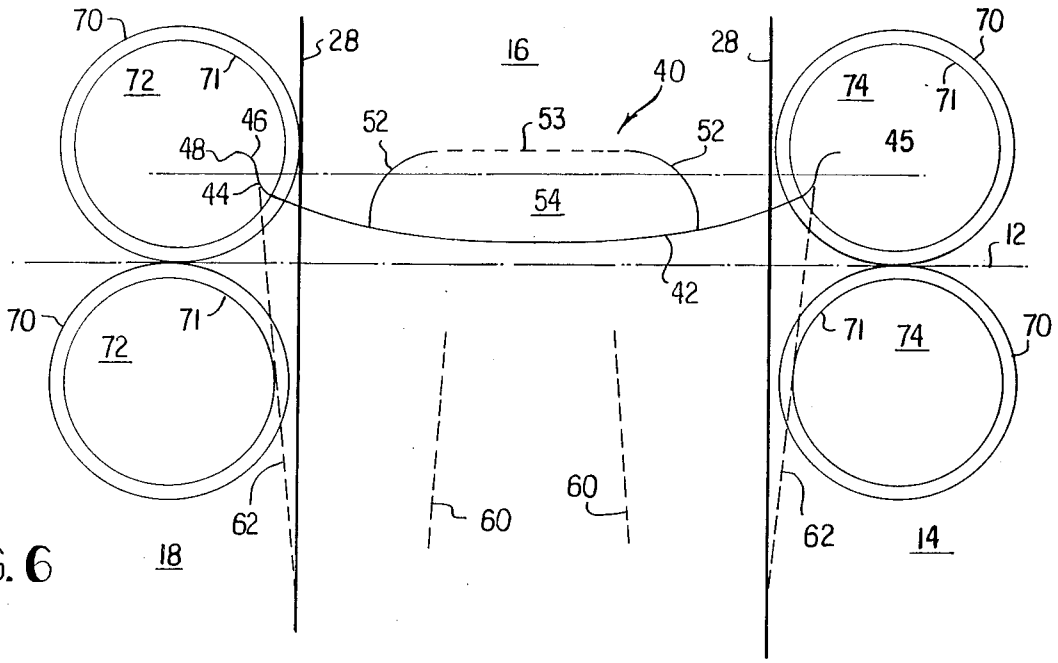
FIG. 6 is a somewhat schematic view of the handle forming portion of the blank of FIG. 1 and illustrates in detail both certain flex lines and precut handle forming lines, in relation to two cans in the carton.

Referring now more particularly to FIG. 6 of the drawings, the relationship between the location of precut lines 40 (defined by cut lines 42, 46 and 52) and two of the cans adapted to be placed in the carton is shown, together with certain flex lines. The reader will note that this relationship is shown as if the three panels 14, 16 and 18 were coplanar. The two uppermost circular outlines illustrated at FIG. 6 are one and the same can 70, with 72 being its top (for example) and 74 denoting its bottom (for example) surface. Similarly, the lower two circular outlines of FIG. 6, those below center line 12, respectively denote the respective top and bottom of an adjacent can 70. The cans are shown of that type of construction wherein the top and bottom surfaces are of a lesser diameter than the main cylindrical body of the can, with the numeral 71 denoting the diminished diameter of the top and bottom surfaces.

The numeral 60 denotes either one of a pair of flex lines extending from slightly below longitudinal axis 12 and extending a short distance down towards the bottom (referring to FIG. 6) of handle panel 16. These flex lines are formed by embossing the interior forming surface of the blank. Flex lines 60, if continued, would each meet cut line 42 orthogonally. The numeral 62 denotes additional flex lines, one lying in side panel 14 and the other lying in side panel 18, also on the carton interior surface. The numeral 45 denotes an imaginary axis passing through the ends 44 of elliptical cut line 42.

The location of each of flex lines 62 is determined by commencing at end point 44 at each end of cut line 42 and then running respective tangents to the smaller diameter 71 of the lower cans 70 and then meeting the edges 28 of panel 16.

The function of flex lines 60 and 62 is to more evenly distribute and thus control stresses which occur in the paperboard when the carton is lifted with filled cans therein.

Again referring to FIG. 6, the radius of curvature of 90 degree circular arcs 46 is preferably 2.5 times the thickness of the corrugated paperboard.

Figure 4:
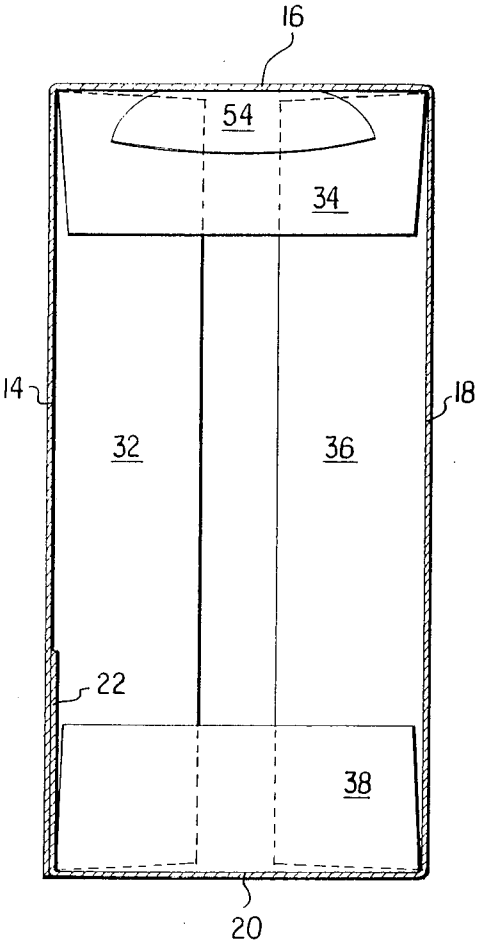
FIG. 4 is a cross sectional view taken along Section 4—4 of FIG. 3.

In operation, the blank of FIG. 1 is folded so that the manufacturer's flap 22, typically being provided with an adhesive, is folded over so that it overlaps the righthand or free edge of panel 14. As is conventional, these overlapping portions of the blank may be crushed prior to gluing together. This operation causes the blank to fold about fold lines 28, to thereby form a rectangular and open ended tube or carton. At this point, one of the two open ends may be closed by bending in and gluing the overlapping portions of end panels 32, 34, 36 and 38. As indicated at FIG. 4, the width of panels 32 and 36 is such that there is a gap between the free edges when assembled. Next, a quantity of aluminum or other cans are placed in the interior of the open ended carton, such that the longitudinal axes of the cans is normal to the side panels 14 and 18 as shown at FIG. 4. In one example of the invention, twenty-four such cans were inserted into the container. Then, the open end is closed and glued, just as the end earlier described.

Figure 5:
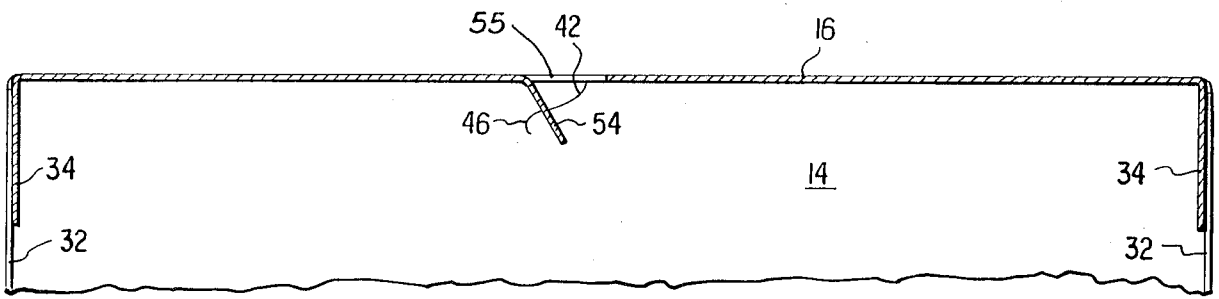
FIG. 5 is a cross sectional view taken along Section 5—5 of FIG. 3.

Referring now to FIG. 5 of the drawings, when the purchaser picks up the carton, four fingers are pushed down on flap 54, with this flap bending about axis 53, thus defining a finger opening 55 in panel 16. The flap 54 is so positioned relative to the cans immediately below it that it is free to swing between them. The finger tips of the purchaser are in contact with the interior surface of handle panel 16, to the right of opening 55 as viewed in FIG. 5, i.e., away from flap 54.

Figure 3:
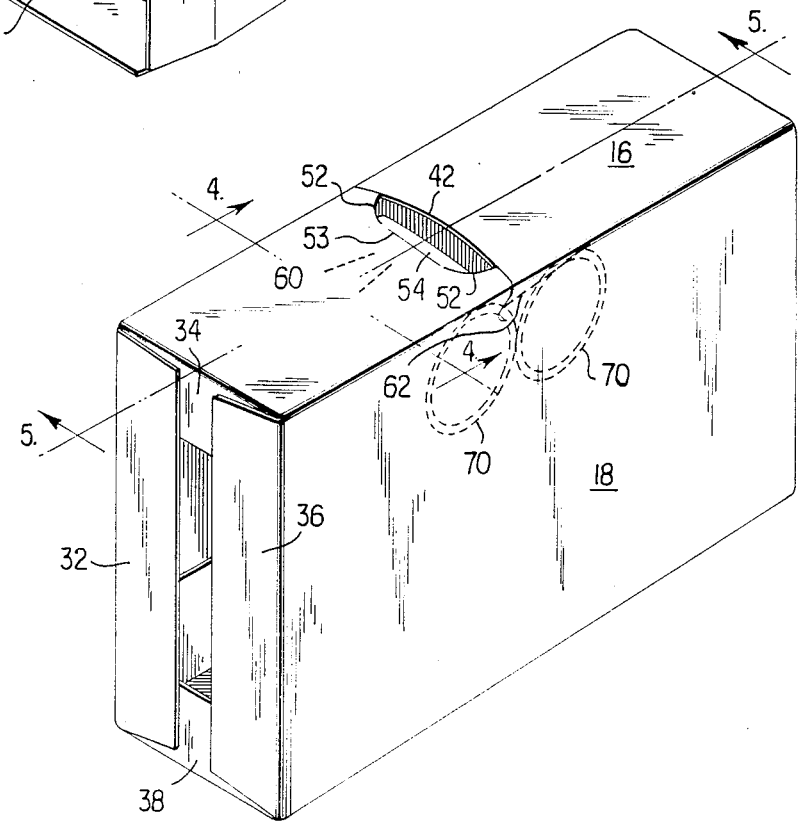
FIG. 3 is a view similar to FIG. 2 showing the carton in its closed configuration.

The function of elliptical cut 42 is to evenly spread the carton load, with the ends 44 extending past the can rim (see FIGS. 3 and 6) to move the fold stress point past the intersection with the can. This latter function is also performed by end arcs 46. The direction of curvature of elliptical cut 42 is opposite to that of arcs 46, to thereby allow the paperboard material to flex freely without binding under stress. Flex lines 60 and 62 control the location of paperboard distortion or flexing around opening 55 when the carton is lifted by the fingers. Lines 60 and 62 are not, however, essential. Further, flap 54 may be omitted, i.e., cut out of the blank. Cut lines 52 may also be omitted, thereby doing away with any recess such as 55 for the fingers to easily enter beneath the handle panel.

Figure 7:
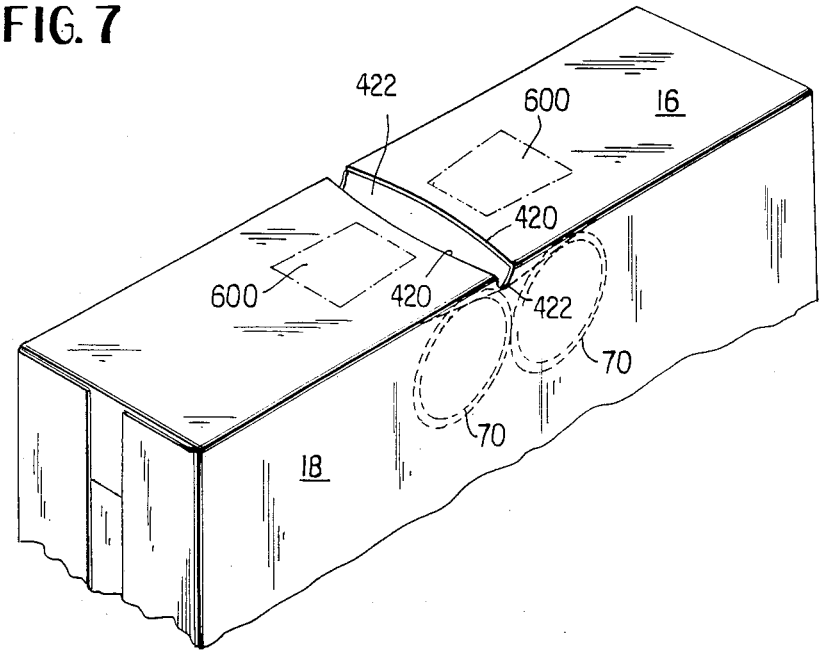
FIG. 7 is a perspective view of the upper portion of a modified form of the can carrier of this invention, the lower portion being similar to the lower portion as shown at FIG. 3.
Figure 8:
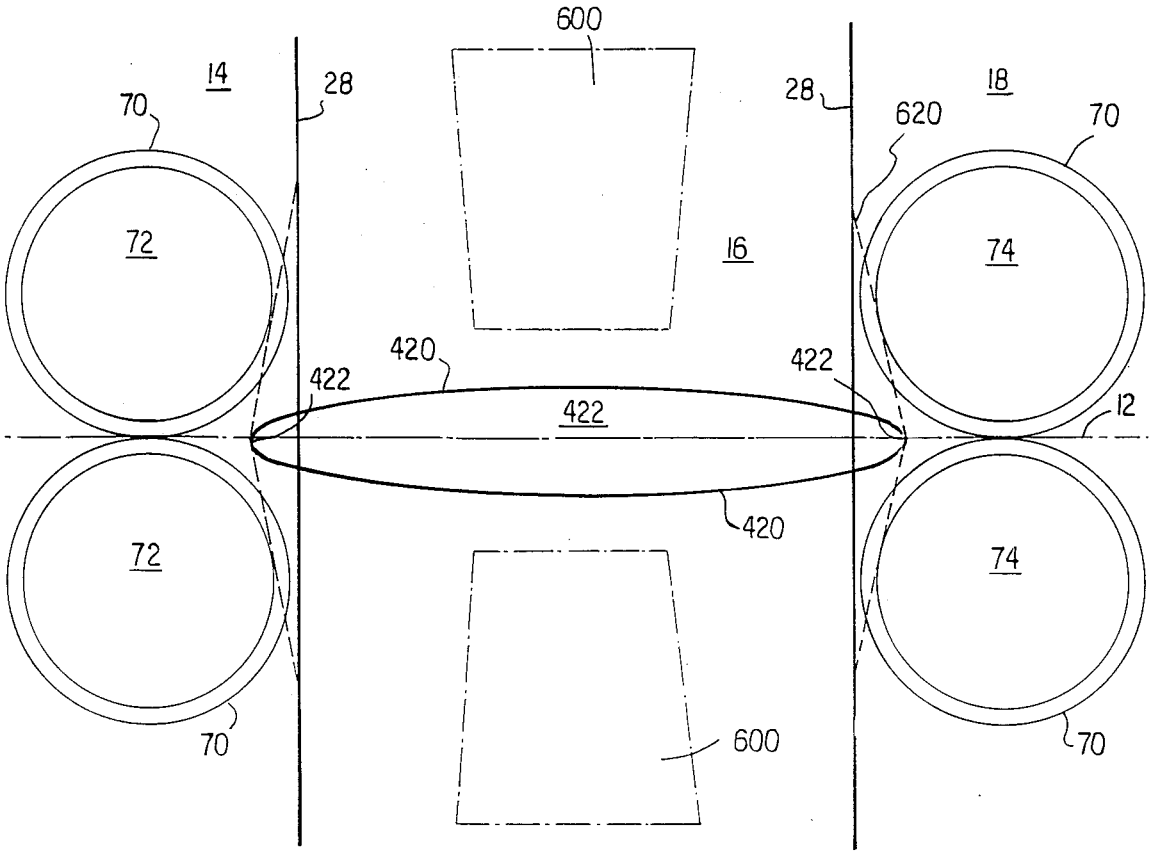
FIG. 8 is a somewhat schematic view of the handle forming portion of the blank from which the can carrier of FIG. 7 is formed.

Referring now to FIGS. 7 and 8, a modified form of the invention is illustrated. In FIG. 7, the can carrier is shown as fully assembled and containing a plurality of, typically, metal cans, two of which are indicated in phantom lines and bear the designation 70. The longitudinal axes of cans 70 are perpendicular to side panel 18. Top panel 16 is provided with a pair of curved cuts 420 which extend completely across the width of handle panel 16, with corresponding ends of cut lines 420 separated by a notch in the side walls, the bottom of the notch bearing the numeral 422. The numeral 600 denotes optional crushed areas in top panel 16, as is conventional in this art. As shown at FIG. 8, cut lines 420, together with the end notches, define a generally elliptical opening in the blank from which the carton of FIG. 7 is formed, the blank being otherwise similar to that shown at FIG. 1. FIG. 8 illustrates the relative position of the ends of cans 70 to longitudinal edges 28 of handle panel 16 (the view being similar to that of FIG. 6) and also show the location of flex lines 620 formed in the side panels 14 and 18.

In use, the customer picks up the can carrier shown at FIG. 7 by inserting several fingers in elliptical opening 422, so that the fingers are beneath panel 16. The fingers may be inserted so as to be directed to the left or to the right referring to FIG. 7, and the can carrier lifted.

Figure 9:
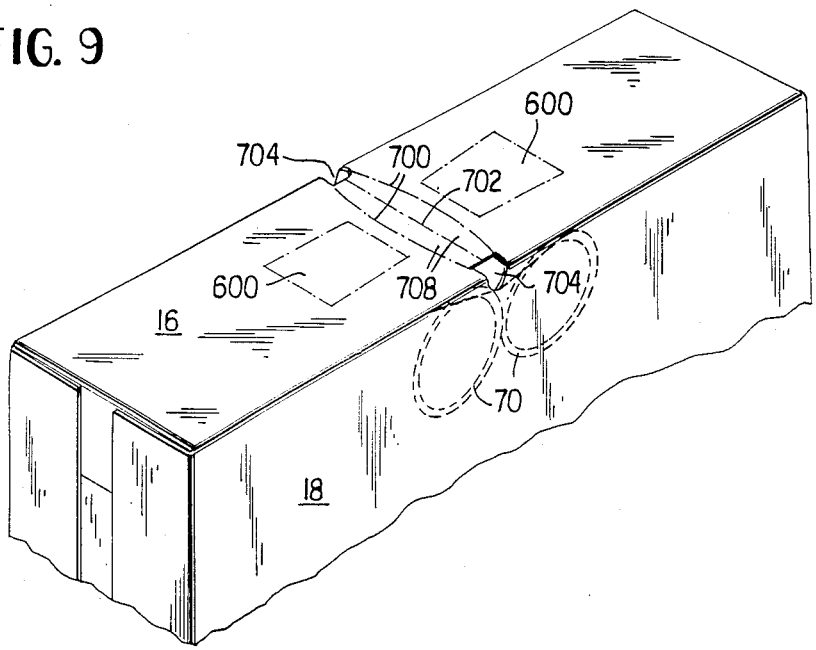
FIG. 9 is a view similar to FIG. 7 and illustrates yet another modified form of the invention.
Figure 10:
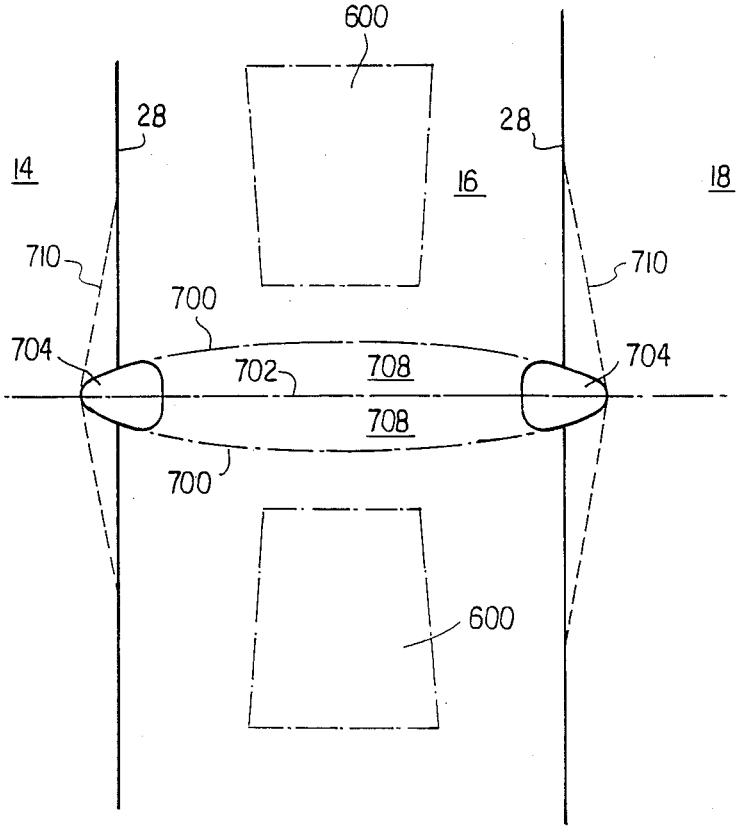
FIG. 10 is a somewhat schematic view of the handle forming portion of the blank from which the can carrier of FIG. 9 is formed.

Referring now to FIGS. 9 and 10, a still further modification is illustrated. As with the modification of FIG. 7, this modification employs a blank identical to that shown at FIG. 1, except for the form of the openings in the handle and adjcent sidewall panels through which the consumer places fingers for lifting. Again, the numeral 600 denotes, optionally, crushed areas in the handle panel. The numeral 700 denotes either one of two generally elliptical fold lines. These fold lines extend generally tranversely across the major portion of handle panel 16 and terminate in part elliptical end openings 704 of the blank, as shown at FIG. 10. The numeral 710 denotes any of four flex lines, each of which extends from the lowermost tips (as shown in FIG. 9) of openings 704 to longitudinal edges 28 of handle panel 16. The numeral 702 denotes a cut line extending completely through the sheet material, cut line 702, opening 704 and fold or hinge score lines 700 define a pair of handle flaps 708. Cut line 702 is colinear with the major axis of the ellipse formed by fold lines 700 and the major portion of the periphery of openings 704.

The function of flaps 708 is to protect the contents of the can carrier from dust, dirt and other contaminates which might otherwise enter the interior of the can carrier between the time the carrier is assembled and filled with the product cans 70 and the ultimate purchase of the carrier by the consumer. In use, the consumer places several fingers down onto either or both of flaps 708, this action bending them downwardly and inwardly, to thereby permit lifting and carrying of the carrier by the purchaser.

Figure 11:
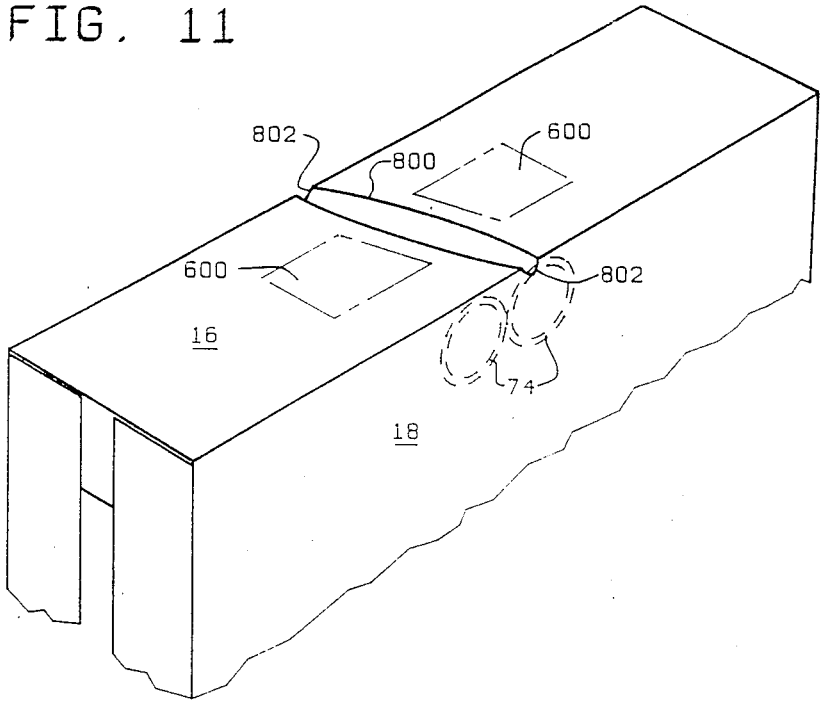
FIG. 11 is a view similar to FIG. 7 and illustrates an embodiment where the major axis of the elliptical handle opening is slanted with respect to the longitudinal axis of the blank, so that the elliptical opening is slanted across the handle panel.

Referring now to FIG. 11, an embodiment is illustrated wherein the elliptical handle opening is slanted with respect to the center line 12 of the blank. Thus, instead of extending at right angles transversely across handle panel 16, it is on a bias or a slant. The handle opening is denoted by the numeral 800 and, as in the embodiment of FIGS. 7 and 8, the narrow ends of the elliptical opening extend down onto the vertical front and back panels of the can carrier.

Figure 12:
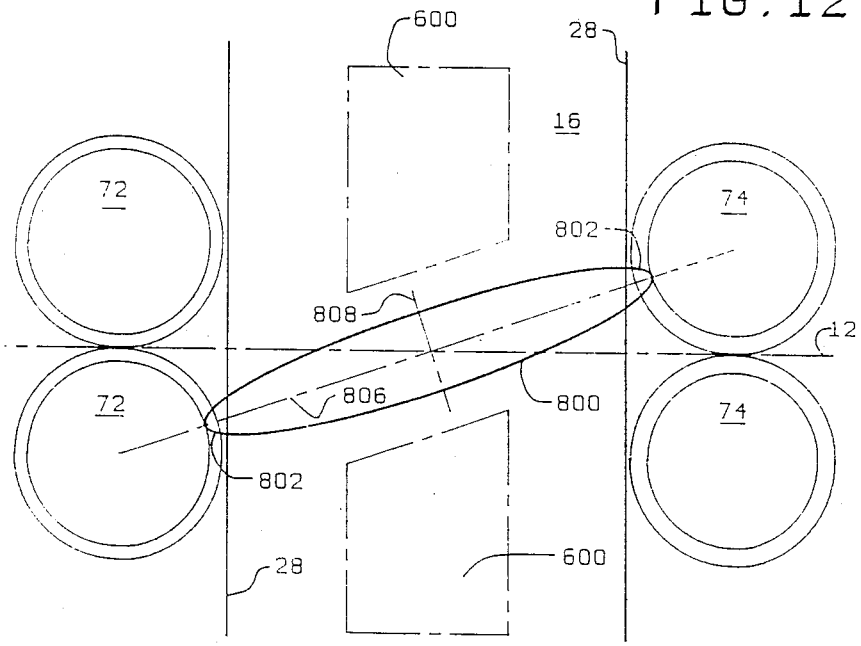
FIG. 12 is a view similar to FIG. 8 and further illustrates the embodiment of FIG. 11.

FIG. 12 further illustrates the construction of FIG. 11. Major elliptical axis 806 is aligned with and extends between the centers of alternate cans in the carrier and is shown at an angle of approximately 20 degrees with respect to center line 12 of the blank. Similarly, minor elliptical axis 808 is approximately 70 degrees with respect to axis 12. In practice, the exact slant of major axis 806 is determined by the diameter of the cylindrical cans 70. Crushed areas 600 on the handle panel 16 may optionally be included.

The terms vertical and horizontal, and other terms of orientation are used to facilitate description of the invention, and are not intended as terms of limitation.

What is claimed is:

1. A one-piece blank of stiff, resilient and foldable sheet material, such as corrugated paperboard, the blank having a longitudinal axis extending midway therealong, the blank adapted to be folded and glued to form a carton, the blank including a series of side, top and bottom forming rectangular panels, said side forming panels foldably serially joined longitudinal edge to longitudinal edge along fold lines, said top forming panel being a handle panel which includes a first cut line extending completely transversely thereacross, said first cut line being curved, the ends of said first cut line extending to and terminating in respective second and third curved cut lines located in respective adjacent side wall forming panels, the second and third cut lines each being curved oppositely from the direction of curvature of said first cut line.

2. The blank of claim 1 wherein said first cut line is of half elliptical shape, the major axis of the ellipse running transversely of the handle panel.

3. The blank of claim 1 including fourth and fifth cut lines, each in the general form of an arc of substantially 90 degrees angular extent, which extend from the concave side of said first cut line, the handle panel portion between the cut line to free ends of said fourth and fifth cut lines adapted to form a fold line, the area of said handle panel bounded by said first, fourth and fifth cut lines and said fold line adapted to form a finger engaging flap when pushed.

4. The blank of claim 1 including side panel flex lines extending from (a) the junctions of the ends of said first cut line with respective second and third cut lines to (6) respective adjacent fold lines joining the side and handle panels, the side panel flex lines located on the convex side of said first cut line, said flex lines located on one surface of the blank.

5. The blank of claim 4 including a diverging pair of handle panel flex lines each extending in a direction orthogonal to said first cut line and on the same side of the latter as said side panel flex lines.

6. A carton formed of stiff, resilient and bendable sheet material, such as corrugated paperboard, the carton being in the general form of a rectangular tube having walls to define horizontal upper and lower walls and vertical side walls, the horizontal upper wall being a handle panel which includes a first cut line extending completely transversely thereacross, said first cut line being smoothly curved and being convex, the ends of said first cut line extending to respective adjacent main side wall panels and terminating in respective second and third curved cut lines in said side wall panels, said second and third cut lines each being curved oppositely from the direction of curvature of said first cut line.

7. The carton of claim 6 including fourth and fifth cut lines each in the general form of an arc of substantially 90 degrees angular extent which extend from the concave side of said first cut line, the handle panel portion beween the free ends of said fourth and fifth cut lines adapted to form a fold line, the area of said handle panel bounded by said first, fourth and fifth cut lines and said fold line, adapted to form a finger engaging flap when pushed orthogonally to the handle flap.

8. The carton of claim 7 including a flex line in each main side panel extending from the junction of an end of said first cut line with a respective said second or third cut line, to an adjacent fold line connecting said handle panel to a respective main side panel.

9. A one-piece blank of stiff, resilient and foldable sheet material, such as corrugated paperboard, the blank having a longitudinal axis extending midway therealong, the blank adapted to be folded and glued to form a carton, the blank including a series of side, top and bottom forming rectangular panels, said side forming panels foldably serially joined longitudinal edge to longitudinal edge along fold lines, said top panel being a handle panel, said handle panel and the two side forming panels which extend laterally from the longitudinal edges of the handle panel having a generally elliptical finger opening cut through the sheet material, the major axis of said opening being substantially transverse to the length of the handle panel, the narrow ends of the elliptical opening each extending into respective said side forming panels by substantially the same amount.

10. The blank of claim 9 including a pair of side panel flex lines extending generally oppositely from the tip of each of said handle opening ends to a respective fold line which joins a respective side forming panel to said handle panel.

11. A carton formed of stiff, resilient and bendable sheet material, such as corrugated paperboard, the carton being in the general form of a rectangular tube having walls to define generally rectangular horizontal upper and lower walls and vertical side walls, the horizontal upper wall being a handle panel, said handle panel and said vertical side walls provided with a generally elliptical finger handle opening, the major axis of said opening being substantially transverse to the length of the handle panel, the narrowest ends of said opening each extending into respective vertical side walls by substantially the same amount.

12. The carton of claim 11 including a pair of flex lines in each vertical side panel extending generally oppositely from the tip of each of said handle ends, to a respective fold line which joins a respective vertical side wall to said handle panel, the junction of an end of said first cut line with a respective said second or third cut line, to an adjacent fold line connecting said handle panel to a respective main side panel.

13. A one piece blank of stiff, resilient and foldable sheet material, such as corrugated paperboard, the blank having a longitudinal axis extending midway therealong, the blank adapted to be folded and glued to form a carton, the blank including a series of side, top and bottom forming rectangular panels, said side forming panels foldably serially joined longitudinal edge to longitudinal edge along fold lines, said top panel being a handle panel, said handle panel having a pair of elliptical fold lines extending transversely across at least the major portion of the width of the handle panel, the ends of said elliptical fold lines merging with portions of the periphery of end openings, one of each of said end openings positioned at least partially in a respective adjacent side wall forming panel, the pair of elliptical fold lines and a portion of the end openings being in the form of an ellipse, a cut line throught the paperboard and extending from one end opening to the other end opening and being colinear with the major axis of said elliptical form.

14. The blank of claim 9 including a pair of side panel flex lines extending generally oppositely from the tip of each of said end openings to a respective fold line which joins a respective side forming panel to said handle panel.

15. A carton formed of stiff, resilient and bendable sheet material, such as corrugated paperboard, the carton being in the general form of a rectangular tube having walls to define generally rectangular horizontal upper and lower walls and vertical side walls, the horizontal upper wall being a handle panel, said handle panel having a pair of elliptical fold lines extending transversely across at least the major portion of the width of the handle panel, the ends of said elliptical fold lines merging with portions of the periphery of end openings, one of each of said end openings positioned at least partially in a respective adjacent side wall forming panel, the pair of elliptical fold lines and a portion of the end openings being in the form of an ellipse, a cut line through the paperboard and extending from one end opening to the other end opening and being colinear with the major axis of said elliptical form.

16. The carton of claim 11 including a pair of flex lines in each vertical side panel extending generally oppositely from the tip of each of said end openings to a respective fold line which joins a respective vertical side wall to said handle panel.

17. A carton formed of stiff, resilient and bendable sheet material, such as corrugated paperboard, the carton being in the general form of a rectangular tube having walls to define generally rectangular horizontal upper and lower walls and vertical side walls, the horizontal upper wall being a handle panel, said handle panel and said vertical side walls provided with a generally elliptical finger handle opening, the major axis of said opening slanting with respect to the length of the handle panel, the narrowest ends of said opening each extending into respective vertical side walls by substantially the same amount.

* * * * *